US005690315A

United States Patent [19]

Thomas

[11] Patent Number: 5,690,315

[45] Date of Patent: Nov. 25, 1997

[54] COMPACT LIFTER ASSEMBLY

[76] Inventor: Timothy N. Thomas, 1242 Devonshire, Grosse Pointe Park, Mich. 48230

[21] Appl. No.: 617,516

[22] Filed: Mar. 15, 1996

[51] Int. Cl.[6] ..... B66F 3/24

[52] U.S. Cl. ..... 254/93 R; 254/89 H; 254/2 C; 187/272

[58] Field of Search ..... 254/93 R, 93 L, 254/93 H, 89 H, 98, 100, 102, 2 R, 2 B, 2 C; 187/372, 272, 225, 207, 229, 226, 233, 213, 215, 234

[56] References Cited

U.S. PATENT DOCUMENTS

| | | | |
|---|---|---|---|
| 732,142 | 6/1903 | Tuggle et al. . | |
| 1,684,729 | 9/1928 | Denio . | |
| 2,059,339 | 11/1936 | Green | 91/46 |
| 2,670,811 | 3/1954 | Shaffer | 254/93 R |
| 3,768,595 | 10/1973 | Kelley, Jr. | 187/229 |
| 3,968,860 | 7/1976 | Atkey | 187/272 |
| 4,095,677 | 6/1978 | Johannson | 187/272 |
| 4,526,345 | 7/1985 | Schmidt | 254/93 R |
| 5,181,693 | 1/1993 | Lorenz | 254/93 R |

FOREIGN PATENT DOCUMENTS

| | | |
|---|---|---|
| 1368427 | 6/1964 | France . |
| 1152376 | 8/1963 | Germany . |

*Primary Examiner*—Timothy V. Eley
*Assistant Examiner*—Lee Wilson

[57] ABSTRACT

A compact lifter assembly having a base plate and a first intermediate plate rigidly connected by a first pair of shafts. A second intermediate plate is slidably attached on the first pair of shafts to be disposed between the base plate and the first intermediate plate. A second pair of shafts extend from the second intermediate plate, through apertures in the first intermediate plate for rigid connection to a mounting plate. A linear actuator centrally located on the base plate is actuated for lifting the mounting plate and a second intermediate plate relative to the base plate. The shafts are rigidly connected to the respective plates by a retaining ring and split taper plugged shaft retention to provide a zero clearance shaft joint connection.

15 Claims, 3 Drawing Sheets

COMPACT LIFTER ASSEMBLY

FIELD OF THE INVENTION

The invention relates to a compact lift assembly that reduces the physical size of the lifter assembly while maintaining the same stroke. Wherein closed height equals the actuator length plus the base plate thickness.

BACKGROUND OF THE INVENTION

In a typical lifter assembly of the prior art, the lifter assembly includes a lifter plate supported by a pair of shafts. The rods are generally disposed through a pair of housings having bearings to slidingly support the shafts. The bottom of the shafts generally are connected by cross support member. A cylinder or linear actuator housed in the center of the typical lifter assembly in the prior art is actuated for extending and retracting a top mounting plate. When the lifter assembly strokes, the shafts connected to the lifter plate must be of sufficient length to travel the stroke and maintain contact with the bearings in the housing. Thus, when the lifter plate is in the retracted position, the shafts of the lifter assembly extend beyond the bottom of the lifter assembly. Therefore, the lifter assembly requires enough physical space for both the upward stroke and the bottom stroke of the lifter plate and rods for the lifter assembly. Another disadvantage of the conventional lifter assembly is that the lifter must be supported from a riser.

SUMMARY OF THE INVENTION

It is the desire of the current invention to address the aforementioned space concern while also providing support and stability to the top mounting plate. It is further a desire of this invention to provide a lifter assembly that can be free standing from a base or from the side as currently provided with the conventional lifter with a riser. In addition, it is desirable to provide a construction having a ring retained rigid shaft mounting to prevent torsional movement of the shafts and repeatable positioning of the top mounting plate.

The current invention provides a compact lifter assembly that reduces the physical size of the lifter assembly while maintaining the same stroke. The lifter assembly includes a top mounting plate supported by a pair of shafts. The shafts are slidably disposed through a plate having bearings which slidingly support the shafts. The bottom of the shafts are connected by a cross support plate. A cylinder in the center of the lifter assembly is actuated for extending and retracting the top mounting plate. When the lifter assembly strokes vertically upward, the shafts and top mounting plate move in pairs relative to each other.

As a result, the current invention provides two pair of substantially parallel shafts wherein one pair of shafts has the top mounting plate connected to the top of the shafts while the bottom of the shafts are connected to a cross support member. The cross support members are slidingly received along the second pair of shafts which are stationarily mounted with respect to the first pair of shafts. The bearings are disposed within the cross support member(s) for slidingly supporting the movement of the cross support member along a second pair of shafts. Therefore, the compact lifter assembly of the current invention does not require the shafts connected to the top mounting plate to extend beyond the bottom of the lifter assembly.

The first pair of shafts are symmetrically spaced from the cylinder on the plates. The second pair of shafts are each spaced from its corresponding first shaft and equidistantly spaced on each side of the cylinder. This configuration creates a bearing spread in both the vertical and horizontal planes increasing the rigidity and the unbalanced load capacity over conventional lifter assemblies having a bearing spread only in the vertical direction.

The shafts are connected to their corresponding plates and cross support members by a retaining ring and split taper plugged shaft retention system which eliminates fastener failure. This connection configuration further provides a rigid zero clearance shaft joint so that torsional movement in the plate to shaft joint is eliminated.

In addition, diagonally placed shocks and hard stops extending from each plate and cross support member are positioned to further increase the rigidity of the mounting plate when in the extended position.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENTS

Figure 1:
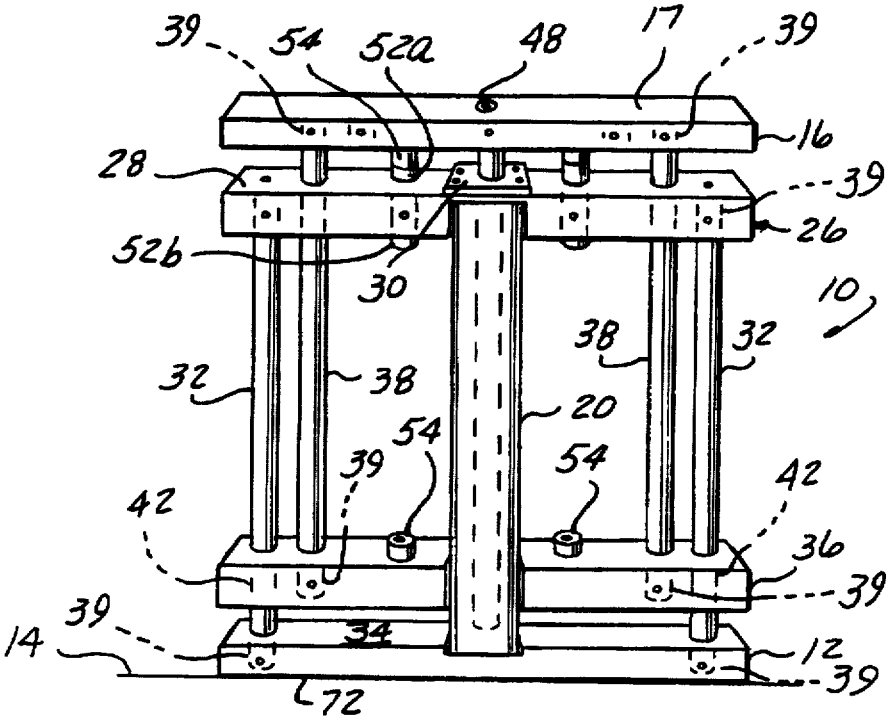
FIG. 1 is a perspective view of the compact lifter assembly in a retracted position.
Figure 2:
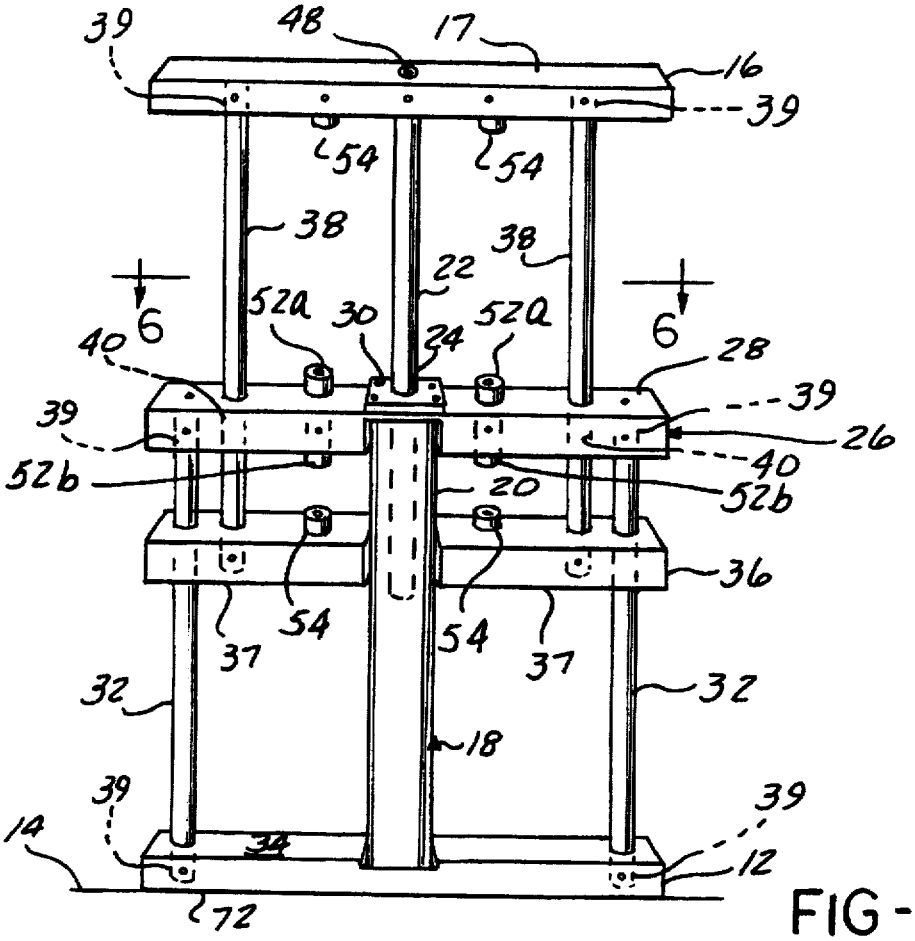
FIG. 2 is a perspective view of the compact lifter assembly in extended position.

The compact lift assembly according to the present invention is shown in FIGS. 1 through 6. FIG. 1 shows the compact lifter assembly 10 in its retracted position, while FIG. 2 shows the compact lifter assembly 10 in a partially extended position. The compact lifter assembly 10 has a base plate 12, preferably made of steel, set on a support surface 14. The support surface 14 may either be a horizontal surface, such as the ground, or a vertical surface, such as a wall. At a distal end from the base plate 12 is a mounting plate 16 also made of steel which supplies the support for an external object (not shown). Disposed between the base plate 12 and the mounting plate 16 are two intermediate plates, preferably made of aluminum. Base plate 12, top mounting plate 16 and the two intermediate plates are positioned in alignment with each other. All of the plates are interconnected by parallel shafts or rails as will be discussed further. Centrally positioned on the base plate 12 is a linear actuator in the form of a cylinder 18 which may be operated by fluid pressure, electronically or by other known means. The cylinder 18 includes an actuator 20 for a piston rod 22. The piston rod 22 extends upward or away from the base plate 12 through the first intermediate plate 26. The cylinder or linear actuator housing 18 must be fastened to an upper or lower surface 28 of the first intermediate plate 26 usually by means of a front flange 30 for added stability. The upper end of the piston rod 22 is securely attached to a central location of the top mounting plate 16 by means of a floating coupling 48.

A first pair of symmetrical guide shafts 32 made of hard chrome plated steel are rigidly secured proximate to either end of the base plate 12 on opposing sides of the cylinder housing 18. Opposing ends of each first guide shaft 32 are rigidly connected to the first intermediate plate 26 by means to be discussed further. Disposed between the base plate 12 and first intermediate plate 26 is a second intermediate plate 36 that is slidably connected to the first pair of guide shafts 32. A second pair of symmetrical guide shafts 38 of hard chrome plated steel are securely attached to the second intermediate plate 36. The second pair of guide shafts 38 are preferably located adjacent to the first pair of guide rails 32, and each second guide shafts 38 is equidistantly spaced on either side of the piston housing 20 to provide the symmetry. The second pair of guide rails 38 are slidably received through bearings 46 in aperture or bore 40 in the first intermediate plate 26. The second pair of guide shafts 38 extend through the apertures 40 in the first intermediate plate 26 and are secured at a distal end to the mounting plate 16. Similarly, the second intermediate plate 36 has bearings 46 in aperture or bore 42 for slidably receiving the first pair of guide shafts 32 as the second intermediate plate 36 moves between base plate 12 and first intermediate plate 26.

In application, when fluid pressure is applied to the linear actuator 20, the piston rod 22 moves away from base plate 12. Second intermediate plate 36 which is rigidly connected to mounting plate 16 by second symmetrical guide shafts 38 moves in response to the movement of piston rod 22 toward first intermediate plate 26. Second guide shafts 38 pass through bearings 46 in the first intermediate plate as guide rails 38 move with the mounting plate 16 and second intermediate plate 36. At the same time, as the second intermediate plate 36 moves, the length of first guide shafts 32 move through bearing 46 in aperture 42. The bearings in intermediate plates 26 and 36 offer greater stability to the guide shafts 32 and 38 and, therefore, to the mounting plate 16. The two pairs of guide shafts 32 and 38 also offer an advantage over a telescopic jack in that the weight of the object on the mounting plate 16 is better dispersed over the bearings 46 in apertures 42 and 40. Therefore, this configuration can tolerate severely overhung loads. This is accomplished even though only a single linear actuator is used.

Figure 3:
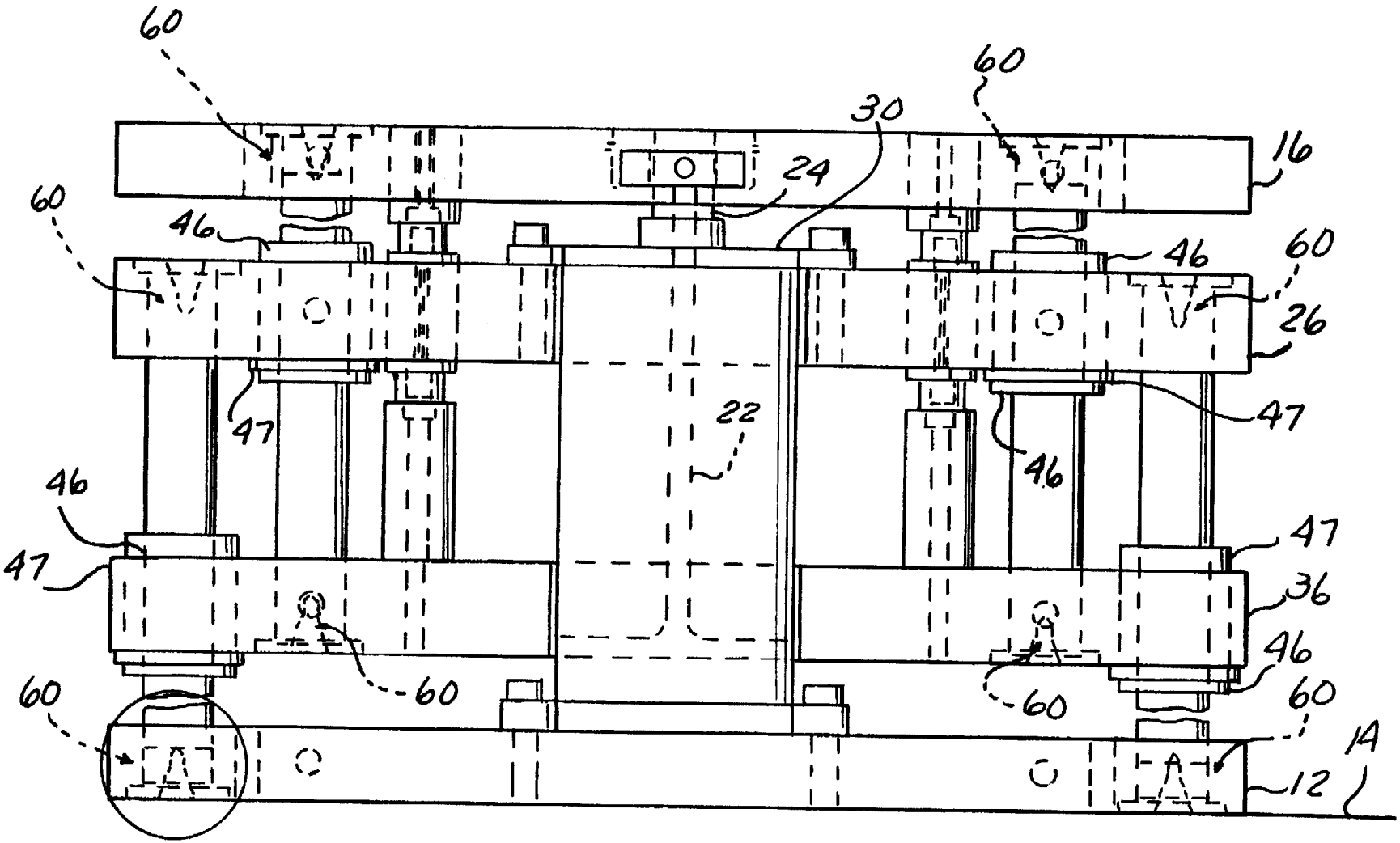
FIG. 3 is a schematic view of the compact lifter assembly in a retracted position.
Figure 4:
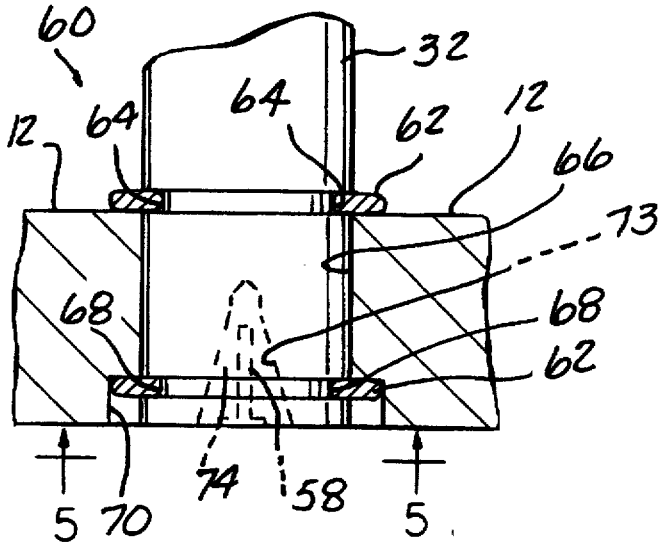
FIG. 4 is an enlarged schematic view of the circled area in FIG. 3 of a shaft connection.
Figure 5:
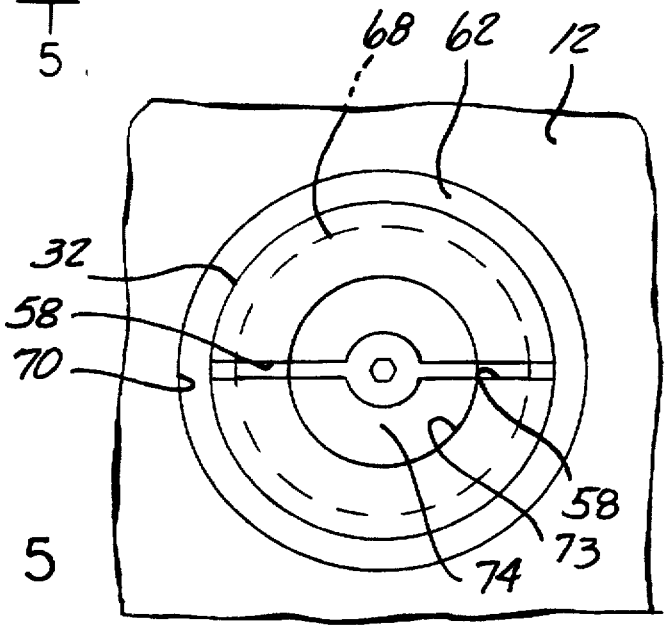
FIG. 5 is a view of the shaft connection in FIG. 4 taken along lines 5—5.
Figure 6:
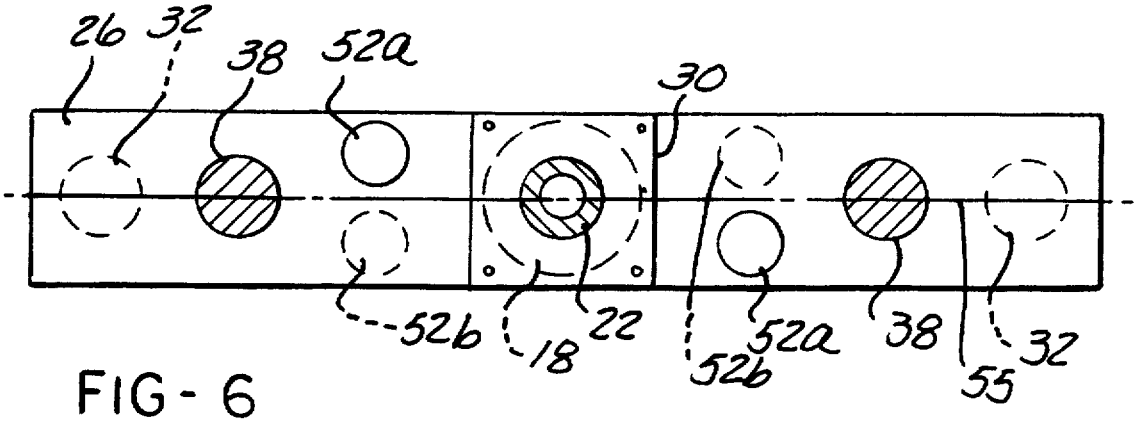
FIG. 6 is a plan view of the lifter assembly taken along lines 6—6 in FIG. 2.

Looking at FIG. 3, a plan view of the compact lift assembly 10 is shown. FIGS. 4 and 5 are enlarged views of the shaft connecting means to its appropriate plate. Here is shown the connecting means for one of the first pair of symmetrical guide shafts 32 to the base plate 12. The assembly discussed hereinafter pertains to the connection of the ends 39 of all of the shafts to their respective plates. The ends 39 of each shaft are connected to their respective plates by ring retained rigid shaft mountings 60. Shown in more detail in FIGS. 4 and 5, the ring retained rigid shaft mounting 60 include the assembly and procedure of tapping each end 39 of the shaft, splitting each shaft end 39 to define a 0.060×1.0 inch depth slot 58. Grooves 64 are made and positioned at the ends 39 of the shafts 32, 38 for placement of spiral wound retaining rings 62. A spiral wound retaining ring 62 is installed in an interior groove 64 spaced at a predetermined exact distance from each shaft end 39. The predetermined exact distance corresponds to the exact distance of the interior groove 64 for placement of the inner spiral wound retaining ring 62 on the corresponding symmetrical shaft 32, 38. This precision alignment ensures that the plate 12 is in an exact horizontal position. The plate 12 has bores 66 to accommodate the shafts 32. The bores 66 are sized to tightly accommodate a single shaft. The shafts 32 are placed through there corresponding bores 66 and set against the spiral wound retaining ring 62 located in the interior groove 64. Another spiral wound retaining ring 62 is then placed in an exterior groove 68 on the shaft 32 on the opposing side of the plate 12. A taper plug 74 is inserted into the tap 73 and turned to expand the outer diameter of the shaft 32 at the slot 58. This procedure and assembly results in a tight interference fit and a total positive retention by the retaining rings 62 between the shaft 32 and the plate 12 thereby eliminating the normal clearance associated with ring retained assemblies. The advantage of this construction provides greater overall rigidity of the shafts and greater endurance of the assembly because the plate bores 40 will not enlarge due to repeated cycling of the compact lifter assembly 10. A counterbore 70 is set around the shaft 32, 38 in the external plate surface exposing the shaft end 39 so that the shaft end 39 is flush with the plate 16. The external plate surface is 72 for base plate 12 and surface 17 for mounting plate 16. The external plate surface for the intermediate second plate is indicated at 37. As can be seen in FIG. 3, the length of the guide shafts 32 and 38 and piston rod 22 can be shortened or lengthened for a particular stroke requirement. The difference in lengths between the two pairs of guide shafts 32 and 38 would be modified by the length of actuator 20.

Shocks **52*a*, 52*b* absorb kinetic energy when contacting corresponding adjustable hard stops 54. Looking at FIGS. 2 and 6, the shock absorbers 52*a*, 52*b* are positioned in a diagonal or cater-corner configuration so that the assembly has an increased rigidity when in the extended position. In other words, the two shocks 52*a* extending upwardly from a plate are diagonally positioned with respect to the cylinder 20 and a center line 55 laterally extending the length of each plate. Another pair of shocks 52*b* extend downwardly from the plate and are diagonally positioned on the plate with respect to cylinder 20 and center line 55. The adjustable hard stops 54 are positioned on opposing plates to contact the shocks 52*a*, 52*b* before adjacent plates meet. The shock absorber 52*a*, 52*b* height is predetermined and constant, while the hard stops 54 have adjustable heights that can vary with the height of the actuator 20**.

In the preferred embodiment, bearings 46 include Teflon lined plane type bearings 46, as shown in FIG. 3, (ball or roller bearings may also be used). Bearings 46 utilize spacer 47 and are located in the through apertures 40 and 42 of the intermediate plates 26 and 36 for supporting, guiding and reducing the friction as the guide shafts 32 and 38 pass therethrough.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law. As an example and although not shown, it is understood that the guide shafts could be transposed with each other such that the second guide shafts 38 are positioned at the outermost perimeter of the upper surface 34 of base plate 34, while first guide shafts 32 are positioned between the linear actuator 20 and second guide shafts 38. The determining configuration depends upon where the support is needed at the mounting plate 16 for a particular application.

What is claimed is:

1. A compact lifter assembly comprising:

a base member supportable on a surface;

a top mounting plate spaced from said base member;

an actuator housed in the center of the compact lifter assembly and extending from the base member, said actuator having a movable rod having an opposing end secured to a center of the top mounting plate;

a movable intermediate support plate; and a stationary intermediate support plate, said movable intermediate support plate slidably disposed between said base member and said stationary intermediate support plate, wherein said movable intermediate support plate is rigidly connected to said top mounting plate, and said stationary intermediate support plate fixedly disposed between said movable intermediate support plate and said top mounting plate, wherein said stationary intermediate support plate is rigidly connected to said base member.

2. The compact lifter assembly of claim 1 further comprising at least one shaft affixed to said base member and extending through an aperture in said movable intermediate support plate to said stationary intermediate support plate, wherein said aperture slidably receives said shaft.

3. The compact lifter assembly of claim 2, further comprising bearings located in the aperture of the movable intermediate support plate for slidingly supporting the shaft.

4. The compact lifter assembly of claim 3, wherein a Teflon lined plain type bearing is located in the aperture for supporting, guiding and reducing the friction of the shaft.

5. The compact lifter assembly of claim 1 wherein at least one of the base member, top mounting plate and movable intermediate support plate has a shock absorber thereon.

6. The compact lifter assembly of claim 1, wherein movement of the movable intermediate support plate and top mounting plate coincides with movement of the movable rod.

7. The compact lifter assembly of claim 6, wherein the bearings are one of Teflon lined plain type bearing, and ball bearing.

8. The compact lifter assembly of claim 1, further comprising a first pair of shafts rigidly connecting the base member and the stationary intermediate support plate and a second pair of shafts rigidly connecting the movable intermediate support plate and the top mounting plate, said first pair of shafts slidably received through apertures in the movable intermediate plate and said second pair of shafts slidably received through apertures in the stationary intermediate support plate when the movable intermediate support plate moves between the base member and the stationary intermediate support plate.

9. A compact lifter assembly actuated by a linear actuator comprising:

a base member supportable on a surface wherein the linear actuator is securely attached to said base member;

a stationary intermediate plate rigidly connected to said base member, wherein said stationary intermediate plate is spaced from said base member by a first pair of parallel shafts symmetrically spaced on said base member from the linear actuator;

a movable intermediate plate slidably connected to the first pair of shafts and fixedly disposed between said base member and the stationary intermediate plate; and a mounting plate rigidly connected to the movable intermediate plate by a second pair of shafts, wherein the linear actuator has a reciprocally moving rod responsive to actuation of said actuator and attached to said mounting plate, wherein said mounting plate and movable intermediate plate move when said linear actuator is activated.

10. The compact lifter assembly of claim 9 wherein the movable intermediate plate moves between the base plate and the stationary intermediate plate coinciding with the movement of the mounting plate.

11. The compact lifter assembly of claim 10 wherein the movable intermediate plate is connected to the mounting plate by a second pair of parallel shafts, wherein said second pair of parallel shafts are symmetrically spaced from the linear actuator and spaced from the first pair of shafts.

12. The compact lifter assembly of claim 10 further comprising at least a pair of shock absorbers diagonally spaced with respect to the linear actuator.

13. A compact lifter assembly actuated by a linear actuator comprising:

a base member supportable on a surface wherein the linear actuator is securely attached to said base member;

a stationary intermediate plate rigidly connected to said base member, wherein said stationary intermediate plate is spaced from said base member by a first pair of parallel shafts symmetrically spaced on said base member from the linear actuator;

a movable intermediate plate slidably connected to the first pair of shafts; and a mounting plate rigidly connected to the movable intermediate plate, wherein the linear actuator has a reciprocally moving rod responsive to actuation of said actuator and attached to said mounting plate wherein said mounting plate is movable when said linear actuator is activated, wherein the movable intermediate plate moves between the base plate and the stationary intermediate plate coinciding with the movement of the mounting plate, wherein the movable intermediate plate is connected to the mounting plate by a second pair of parallel shafts, wherein the first pair of parallel shafts are connected to the base member and the stationary intermediate plate and the second pair of parallel shafts are connected to the mounting plate and the movable intermediate plate by connecting means, wherein the connecting means includes an aperture in each respective plate for receiving the respective shaft and a split taper plugged shaft retention for securing the respective shaft within the aperture of the respective plate, creating a rigid, zero clearance ring retained joint between each respective shaft and the respective plate.

14. The compact lifter assembly of claim 13, wherein the connecting means includes grooves spaced approximately near the end of each respective shaft and spiral wound retaining rings disposed therein, said rings disposed between said corresponding plate and shaft.

15. The compact lifter assembly of claim 14, wherein each aperture has bearings therein for support, guiding, and reducing the friction of the shaft.

* * * * *